US007923616B2

(12) United States Patent
Hamilton

(10) Patent No.: US 7,923,616 B2
(45) Date of Patent: Apr. 12, 2011

(54) STRINGED INSTRUMENT FOR PRODUCING PRECISE RHYTHMIC STRUMMING

(76) Inventor: Robert N. Hamilton, San Antonio, TX (US)

( * ) Notice: Subject to any disclaimer, the term of this patent is extended or adjusted under 35 U.S.C. 154(b) by 209 days.

(21) Appl. No.: 12/053,746

(22) Filed: Mar. 24, 2008

(65) Prior Publication Data

US 2009/0235805 A1 Sep. 24, 2009

(51) Int. Cl.
*G10D 1/08* (2006.01)

(52) U.S. Cl. ..... 84/267

(58) Field of Classification Search ..... 84/267, 84/291, 320–322
See application file for complete search history.

(56) References Cited

U.S. PATENT DOCUMENTS

| | | | | |
|---|---|---|---|---|
| 526,221 | A | 9/1894 | Connery | |
| 3,018,680 | A | 1/1962 | Paul | |
| 3,375,747 | A | 4/1968 | Posey | |
| 4,046,050 | A | 9/1977 | Fender | |
| 4,248,128 | A | 2/1981 | Des Gaines | |
| 4,987,815 | A * | 1/1991 | Shockley | 84/291 |
| 4,993,301 | A | 2/1991 | de los Santos | |
| D392,668 | S | 3/1998 | Shingler | |
| D395,330 | S | 6/1998 | Sarno | |
| D427,229 | S | 6/2000 | Ellis | |
| 6,369,304 | B1 | 4/2002 | Tucker | |
| 6,369,305 | B1 | 4/2002 | Powers et al. | |
| 6,399,864 | B1 | 6/2002 | Willcutt | |
| 6,441,293 | B1 | 8/2002 | LaBarbera | |
| 6,891,095 | B2 | 5/2005 | Charters | |
| 7,312,388 | B2 * | 12/2007 | Oskorep | 84/322 |
| 7,462,767 | B1 * | 12/2008 | Swift | 84/291 |
| 2004/0182221 | A1 * | 9/2004 | Burrell | 84/291 |
| 2004/0187668 | A1 * | 9/2004 | Charters | 84/320 |
| 2005/0223872 | A1 * | 10/2005 | Greenwald | 84/322 |

* cited by examiner

*Primary Examiner* — Kimberly R Lockett
(74) *Attorney, Agent, or Firm* — Gunn, Lee & Cave, P.C.; Edward B. Marvin

(57) ABSTRACT

The present invention is a stringed instrument for producing rapid tempo and more precise rhythmic strumming. The shape of the strumming apparatus allows simultaneous contact of two or more strings from a plurality of strings, and thereby allows chords to be more efficiently produced. In combination with the strumming apparatus, the present invention includes an instrument body with recessed components on the front surface of the instrument body. Combining the strumming apparatus and an instrument body as in the present invention allows a user to achieve greater rhythmic precision and a faster tempo vis-à-vis faster paced strumming of the strings.

13 Claims, 6 Drawing Sheets

STRINGED INSTRUMENT FOR PRODUCING PRECISE RHYTHMIC STRUMMING

CROSS REFERENCES TO RELATED APPLICATIONS

None

STATEMENT REGARDING FEDERALLY SPONSORED RESEARCH OR DEVELOPMENT

Not applicable

BACKGROUND OF THE INVENTION

1. Technical Field

The present invention relates generally to an improved stringed instrument for producing precise rhythmic strumming. More specifically, the invention relates to a stringed instrument with recessed components on the front surface of the instrument body used in combination with a strumming apparatus capable of simultaneous contact with a plurality of strings.

2. Description of the Related Art

Guitars are well-known stringed instruments that have many different variations and are found in all sorts of shapes and sizes. Some have one neck connected to the soundboard and some have two. Some guitars come with four strings, others come with six, and some have twelve. There are slide guitars, bass guitars, acoustic guitars, electric guitars, and steel guitars, as well as others. Regardless of the type, all guitars have one thing in common: their strings are pulled and released to create vibration and therefore sound. The pulling and releasing of individual string is commonly referred to in the art as plucking, while rapid, sequential plucking is commonly referred to as strumming.

To play a guitar, the strings are usually plucked or strummed in the area of the soundboard (i.e., the instrument body) with one hand while the other hand changes musical notes at the neck. In this regard, the plucking or strumming hand usually contacts the strings somewhere between a bridge (i.e., where the strings are attached to the soundboard) and the soundboard/neck intersection. The strumming hand can produce single notes by plucking individual strings, or to produce chords, each string is plucked rapidly and sequentially (i.e., strummed) in a path that travels from the first string to the last string in an upward playing stroke and vice versa in a downward one.

The actual pulling and releasing of strings during plucking or strumming is achieved with fingers or some type of plectrum. Plectrums come in many different shapes and sizes, with the most recognized form of a plectrum being the common guitar pick—a thinly shaped object made for plucking individual strings that is typically held between a player's thumb and forefinger.

Many variations of the common guitar pick are known and disclosed in the prior art. For example, U.S. Pat. No. 4,993,301 ('301 patent) discloses a traditional guitar pick that has been modified with serrated edges for creating a percussive effect on individual strings. Another variation is shown in U.S. Pat. No. 4,248,128 (the '128 patent), where a plurality of traditional guitar picks are in spaced relation to form a guitar pick array. As compared to a single pick, it is claimed that the guitar pick array of the '128 patent creates a unique tone when it hits individual strings.

Common to both the '301 patent and the '128 patent, these modified picks can only pluck a single string at a time and the tempo of the composition is limited to the speed at which the strumming hand can physically pluck the strings. For example, to play chords the strumming hand must rapidly and sequentially pluck individual strings over a definable distance—from the first string to the last string on upward playing strokes and vice versa on downward playing strokes. As a result, the tempo of chords is limited to the speed at which the strumming hand can physically travel this distance, reverse directions, and travel the distance again. Similarly, the tempo of individual notes is also limited to strumming hand's physical ability to move from string to string. In line with the physical limitation, a strumming hand also tires after long periods of increased tempo and the ability to play chords or notes is further limited due to strumming-hand fatigue.

Limitations on the tempo affect the overall rhythm of the musical composition. Many times, the rhythm falls behind that which is called for because the guitar player cannot physically achieve the notes or chords required. Then, in an effort to keep up with the required tempo, the guitar player compensates by either hurrying the composition (i.e., trying to squeeze in more notes than called for in a particular measure) or skipping notes altogether.

To combat the problem of tempo limitation, larger strumming apparatuses have been devised. For example, U.S. Pat. No. 6,891,095 ('095 patent) discloses a multi-pick apparatus that has a plurality of pick members for playing multiple notes at a time. While the '095 patent seems to decrease the distance required to produce a chord, it does not solve the problem of tempo limitation from fatigue. With the '095 patent, the user must maintain the strumming apparatus at a constant distance from the strings for the pick members to engage the strings as designed, despite the strumming hand's natural tendency to move inward toward the strings and the front surface of the instrument body during strumming. As a result, the '095 patent requires added energy to prevent the strumming apparatus from moving inward. Furthermore, the numerous pick members in the '095 patent make precision plucking of individual notes cumbersome, and extra effort is required to accurately pluck individual notes without hitting other strings.

The present invention is directed towards overcoming the above-described problems associated with precise high speed strumming and plucking. Unlike the prior art, the present invention combats the problem of strumming-hand fatigue through a modified instrument body in combination with a modified, accurate strumming apparatus.

BRIEF SUMMARY OF THE INVENTION

In accordance with one aspect of the present invention, the components on the front surface of an instrument body have been recessed to create a front surface that is as unobstructed as possible. With regard to the strumming apparatus, it is constructed so that the user can simultaneously contact two or more strings and the instrument body itself, without adversely affecting the sound of the strings.

The combination of recessed components on the front surface of the instrument body and the strumming apparatus of the present invention are necessary due to the manner in which the present invention is played. In this regard, the user moves the strumming apparatus inward to percussively hit the strings like felt hammers hit strings in a piano, while at the same time, the user moves the strumming hand upward or downward in a strumming motion known to guitars. Thus, instead of expending effort against the natural tendency of the strumming hand to move inward toward the front surface of the instrument body, the present invention embraces this natural tendency and thereby decreases fatigue.

Because the playing technique of the present invention requires inward percussive force on the strings, the strumming apparatus often inadvertently strikes the front surface of the instrument body at the beginning of upward and downward playing strokes, prior to contacting the strings. In these instances, the strumming apparatus must be able to smoothly transition from its position on the instrument body to the strings themselves without becoming obstructed on surface components that are commonly found on stringed instruments, such as the bridge and saddle. To accomplish the smooth transition, all substantial obstructions must be eliminated from the front surface of the instrument body, and if not, the strumming apparatus may become obstructed, which would adversely affect the rhythm of the musical composition.

To eliminate obstructions on the front surface of the instrument body, the stringed instrument of the present invention has recessed surface components. In this regard, the bridge and the tailpiece that attach the strings to the instrument body are recessed into a protrusion on the front surface of the instrument body. This protrusion rises outwardly, away from the front surface and it is smoothly contoured. Similar to the bridge and tailpiece, the portion of the strings between the bridge and tailpiece is also recessed into the outward protrusion. As discussed below, the outward protrusion prevents the strumming apparatus from becoming obstructed and essentially removes all possible surface obstructions.

In accordance with another aspect of the present invention, the strumming apparatus is constructed to percussively strike the strings while strumming or plucking them at the same time. Hence, the strumming must be rigid enough to withstand the percussive forces it will encounter from striking the strings and the inadvertent forces it will encounter from striking the front surface of the instrument body. In addition, the strumming apparatus should be shaped so that a user can simultaneously contact two or more strings from the plurality of strings but also accurately contact individual strings. Such a shape enables rapid production of chords and individual notes.

Combining the strumming apparatus and recessed surface components, the present invention allows ease in producing accurate strumming and plucking quickness previously unknown in the art. This increased ease of strumming accuracy produces precise rhythms and a unique sound that heretofore has not been possible.

BRIEF DESCRIPTION OF THE DRAWINGS

The present invention, as well as further objects and features thereof, are more clearly and fully set forth in the following description of the preferred embodiment, which should be read with reference to the accompanying drawings, wherein.

DETAILED DESCRIPTION OF THE INVENTION

Figure 1:
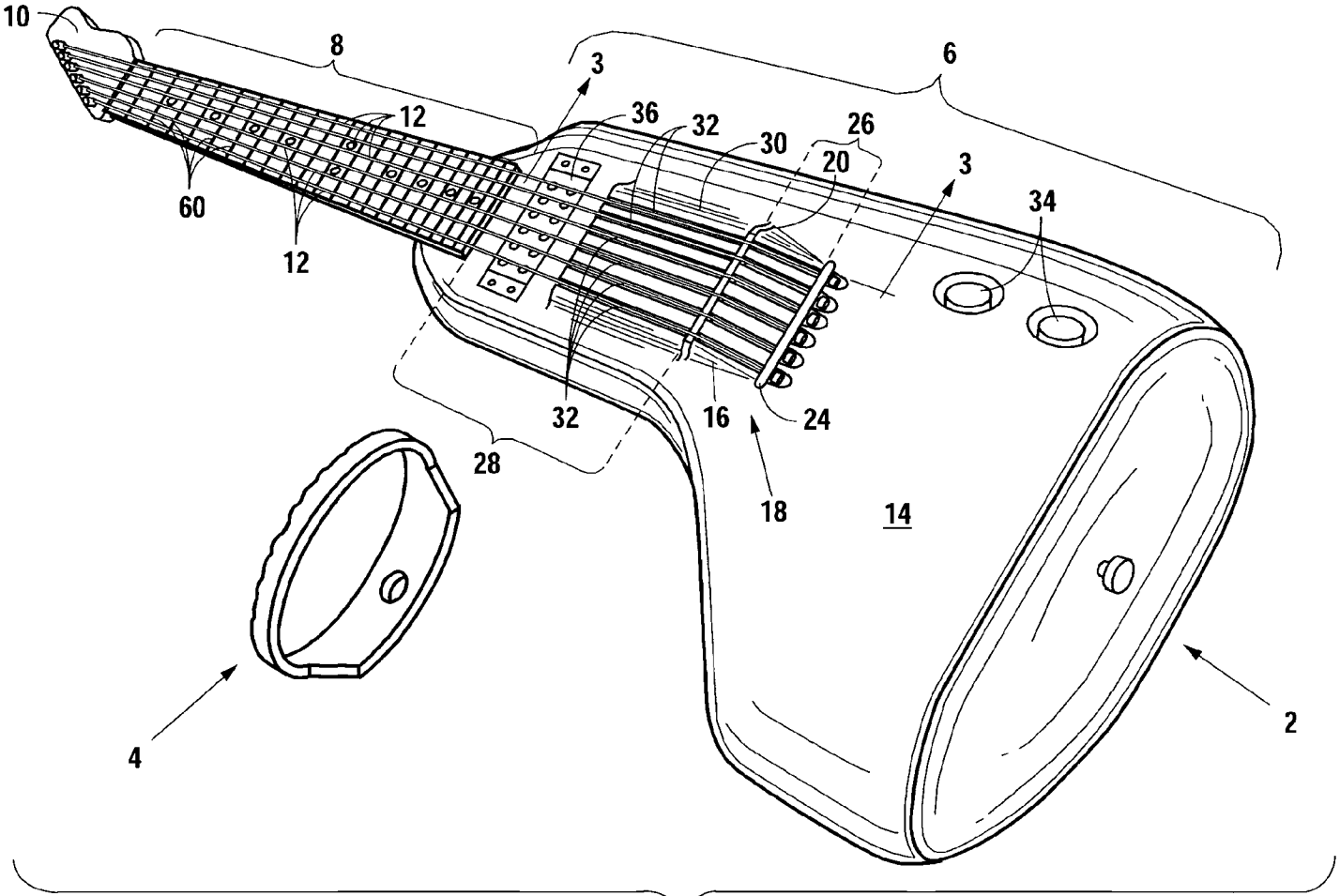
FIG. 1 illustrates a perspective view of a stringed instrument and strumming apparatus incorporating the preferred embodiment of the present invention.

FIG. 1 discloses a stringed instrument 2 for the preferred embodiment of the present invention. The stringed instrument 2 comprises a strumming apparatus 4, an instrument body 6, a neck 8 that contains a plurality of frets 60, a head 10, and a plurality of strings 12. The instrument body 6 has a front surface 14 with an outward protrusion 16 extending therefrom. In the preferred embodiment shown, the outward protrusion 16 is a separately manufactured piece that is permanently or removeably mated to the front surface 14 of the instrument body 6.

The plurality of strings 12 attaches to the instrument body 6 through a string-attaching assembly 18. In the preferred embodiment, the string-attaching assembly 18 comprises a bridge/saddle assembly 20 and a tailpiece 24. The plurality of strings 12 has a first-end area 26 within the string-attaching assembly 18, located between the bridge/saddle assembly 20 and the tailpiece 24. Critical to the invention, the string-attaching assembly 18 and the first-end area 26 are substantially recessed into the outward protrusion 16, as will be discussed in more detail hereunder. Between the string-attaching assembly 18 and the neck 8 of the stringed instrument 2, the plurality of strings 12 are aligned to define a playing surface 28 accessible for contact by the strumming apparatus 4, which also will be discussed in greater detail hereunder.

In the preferred embodiment of the present invention, the instrument body 6 further comprises a striker platform 30 with its sides contoured so that the striker platform 30 does not obstruct the motion of the strumming apparatus 4. The striker platform 30 contains a plurality of grooves 32 parallel to and located beneath the plurality of strings 12, as more fully shown in FIGS. 5*a* and 5*b*. The plurality of grooves 32 must be at least large enough to accommodate entry of individual strings that enter into the individual grooves during playing without affecting the vibration of the string while in the groove. The striker platform 30 extends outwardly from the front surface 14 of the instrument body 6, and in its preferred embodiment, the striker platform 30 is a separately manufactured piece that is permanently or removably mated to the front surface 14 of the instrument body 6.

FIG. 1 also discloses an instrument body 6 that includes recessed electronic controls 34 and a pickup 36 with recessed and contoured bracket holders for electronic operation of the stringed instrument 2 in the preferred electronic embodiment of the present invention. Though shown as cylindrical knobs in FIG. 1, the electronic controls 34 are any mechanism mounted on the stringed instrument 2 and used to alter sound qualities of the stringed instrument 2 vis-à-vis alterations of electronic signals. As shown in their preferred embodiment the electronic controls 34 are mounted on the front side of the instrument body 6 and are recessed below the front surface 14; however, in other electronic embodiments the need for recessing the electronic controls 34 is alleviated if the electronic controls 34 are not mounted on the front side of the instrument body 6.

Figure 2:
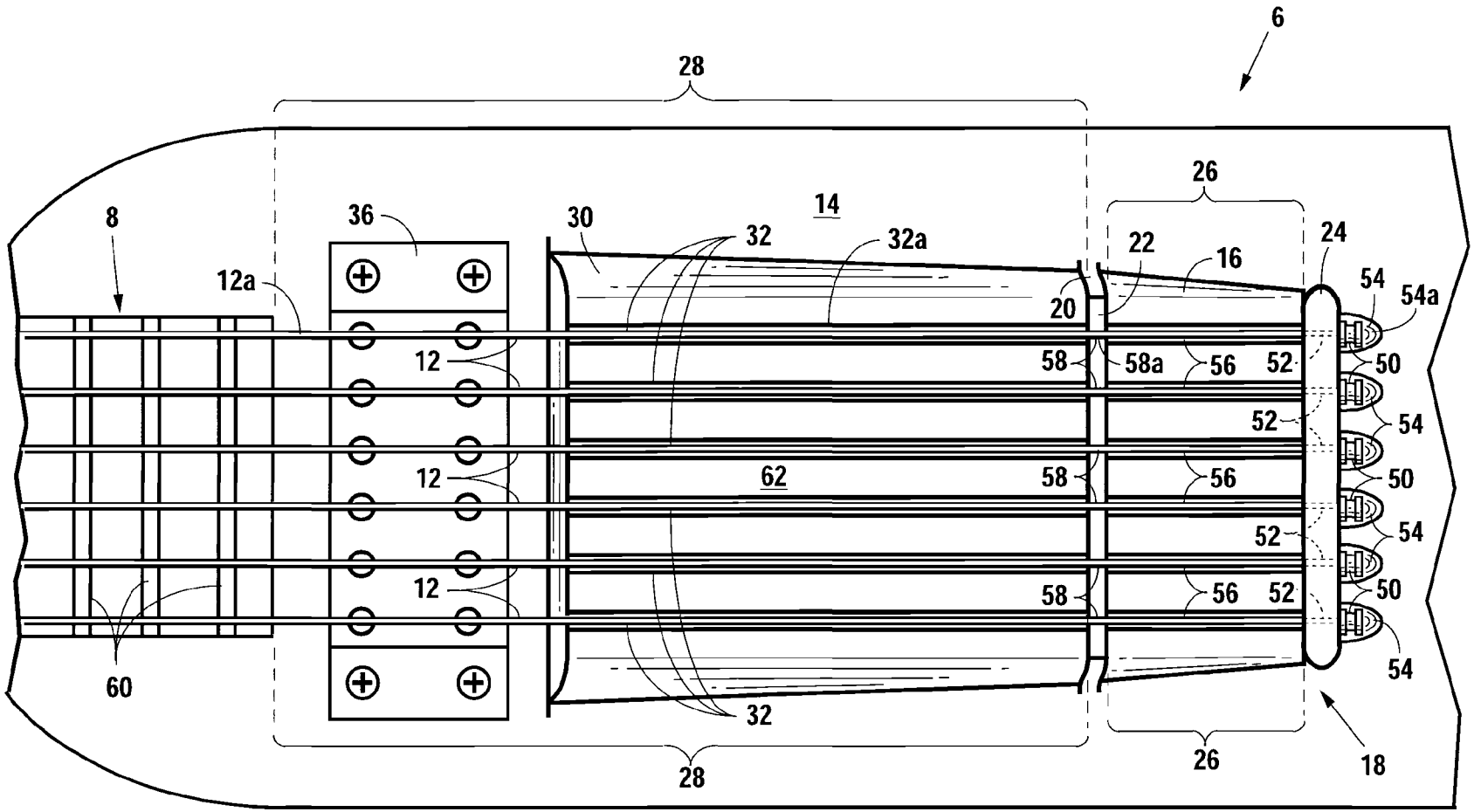
FIG. 2 shows an exploded, partial top view of the preferred embodiment of the stringed instrument.

FIG. 2 discloses a partial exploded view of the instrument body 6 and shows the playing surface 28 of the plurality of strings 12 and the string-attaching assembly 18 in greater detail. Although other embodiments of the present invention utilize other methods of attaching the plurality of strings 12 to the instrument body 6, the string-attaching assembly 18 from the preferred embodiment shown in FIG. 2 is comprised of a bridge/saddle assembly 20 and a tailpiece 24. The bridge/saddle assembly 20 is elevated away from the front surface 14 of the instrument body 6 while the tailpiece 24 is substantially flush with the front surface 14.

Under the string-attaching assembly 18 of the preferred embodiment, each string within the plurality of strings 12 has a knob end 50 located adjacent to the tailpiece 24 on the side opposite from the neck 8. From their knob end 50, each string in the plurality of strings 12 is threaded through a string-hole 52 in the tailpiece 24, and extends toward the first-end area 26 of the plurality of strings 12. The circumference of each string-hole 52 is smaller than its accompanying knob end 50 and when tension is applied to each string within the plurality of strings 12 from the head 10 of the stringed instrument 2 (see FIG. 1), the knob end 50 anchors each string at the tailpiece 24. At the tailpiece 24, a plurality of notches 54 containing a first notch 54*a* are cut into the front surface 14 of the instrument body 6, which allows the knob end 50 of each individual string to be recessed below the front surface 14 of the instrument body 6.

From the tailpiece 24, the plurality of strings 12 extends toward the playing surface 28 by rising away from the front surface 14 of the instrument body 6 until reaching the bridge/saddle assembly 20. The area where the plurality of strings 12 rises away from the front surface 14 (i.e., between the bridge/saddle assembly 20 and the tailpiece 24 in the preferred embodiment) is the first-end area 26 of the plurality of strings 12. In the first-end area 26 of the preferred embodiment, individual strings from the plurality of strings 12 are recessed into a first-end groove 56 within the outward protrusion 16 of the instrument body 6. In this regard, the outward protrusion 16 has a sloped rise that corresponds to the rise of the plurality of strings 12 away from the front surface 14, with the outermost portion of the outward protrusion 16 becoming substantially flush with the top surface of the saddle 22 from the bridge/saddle assembly 20. As a result, the bridge/saddle assembly 20 becomes integrated into the outward protrusion 16.

Once at the bridge/saddle assembly 20, the plurality of strings 12 passes over the top surface of the saddle 22. The top surface of the saddle 22 comprises a plurality of saddle grooves 58 containing a first saddle groove 58*a*. At the top surface of the saddle 22, each string within the plurality of strings 12 is seated within its own respective saddle groove, causing each string to be substantially flush with the top surface of the saddle 22. From the top surface of the saddle 22 and the bridge/saddle assembly 20, the plurality of strings 12 extends along the playing surface 28.

The playing surface 28 of the plurality of strings 12 in the present invention is located between the neck 8 and the bridge/saddle assembly 20, and in the preferred embodiment, the playing surface 28 is located over the striker platform 30. The striker platform 30 is positioned on the front surface 14 of the instrument body 6 adjacent to the string-attaching assembly 18 and is shaped at its edges so as not to obstruct the strumming apparatus 4 during playing (see FIGS. 5*a* & 5*b*). In addition, as noted above, the striker platform 30 contains a plurality of grooves 32 situated in close proximity and aligned parallel to the plurality of strings 12 so that each individual string from the plurality of strings 12 has a corresponding groove (see FIGS. 5*a* & 5*b*). Within the plurality of grooves 32, the striker platform 30 contains a first groove 32*a* situated in close proximity and aligned parallel to a first string 12*a* from the plurality of strings 12.

From the striker platform 30, the plurality of strings 12 extends toward the neck 8 of the stringed instrument 2. Prior to reaching the neck 8, the plurality of strings 12 passes over the pickup 36 used in the preferred electronic embodiment of the present invention. After passing over the pickup 36, the plurality of strings 12 continues toward the head 10 of the stringed instrument 2 (see FIG. 1). In its preferred embodiment, the neck 8 contains a plurality of frets 60 (see FIG. 1), which is used to vary the pitch and tone of the sound coming from the vibrating plurality of strings 12 during playing. Proceeding up the neck 8, each string is eventually secured at the head 10 (see FIG. 1), where tension is applied.

Figure 3:
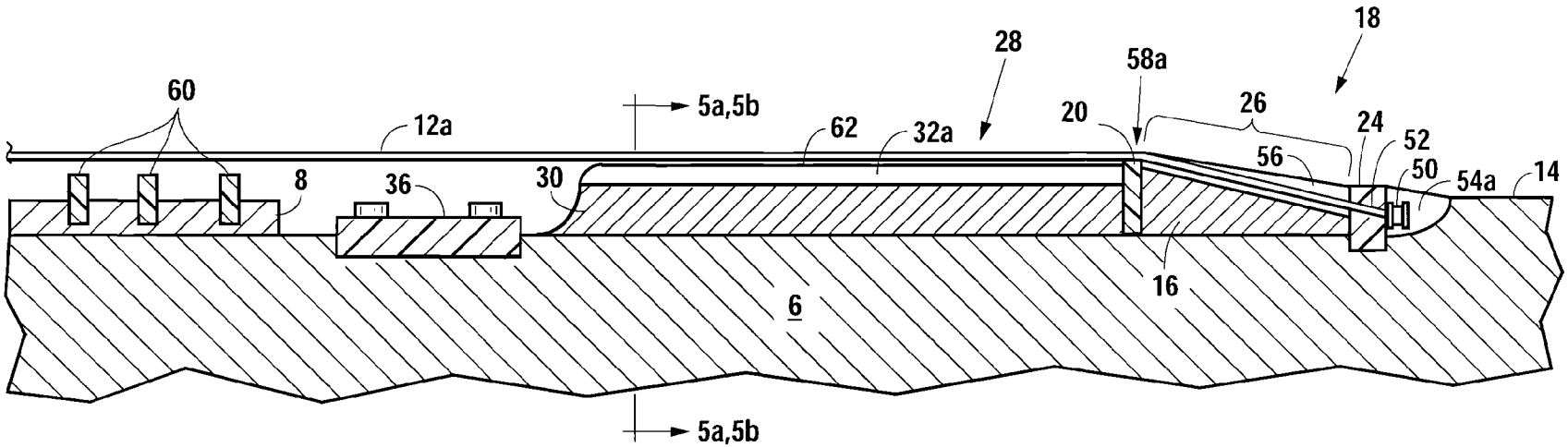
FIG. 3 is a partial cross-sectional view of the preferred embodiment of the stringed instrument at section line 3-3 of FIG. 1.

FIG. 3 shows a cross section of the instrument body 6 along section line 3-3 in FIG. 1. Section line 3-3 bisects (1) the first groove 32*a* on the striker platform 30, (2) the first saddle groove 58*a* from the plurality of saddle grooves 58, and (3) a first-end groove 56 within the outward protrusion 16 of the instrument body 6, so as to show the spatial relationship of the first string 12*a* to these grooves. Starting from the knob end 50, the first string 12*a* passes through its corresponding string-hole 52 in the tailpiece 24. At the knob end 50, a cross-section of the first notch 54*a* from the plurality of notches 54 (see FIG. 2) is shown, and discloses how the knob end 50 is recessed below the front surface 14 of the instrument body 6 in the preferred embodiment. The first string 12*a* then enters into a first-end groove 56 in the outward protrusion 16 of the instrument body 6.

The cross-sectional view of the preferred embodiment in FIG. 3 also shows the slope of the outward protrusion 16 away from the front surface 14 of the instrument body 6 and discloses how the string-attaching assembly 18 of the preferred embodiment is recessed. As shown, the slope of the outward protrusion 16 rises away from the front surface 14 of the instrument body 6 and the outward protrusion 16 becomes substantially flush with the top surface of the saddle 22 and the bridge/saddle assembly 20. Contained within the outward protrusion 16, the first string 12*a* is seated in a first-end groove 56 so as to recess the first string 12*a* in the first-end area 26. Similarly, in the string-attaching assembly 18 of the preferred embodiment each string within the plurality of strings 12 is seated in a corresponding first-end groove 56, which allows the entire first-end area 26 of the plurality of strings 12 to be recessed (see FIG. 2).

After passing through the first saddle groove 58*a*, FIG. 3 shows a cross-sectional side view of the first string 12*a* positioned relative to the striker platform 30. The spatial relationship between the first string 12*a* and the first groove 32*a* in FIG. 3 exemplifies the spatial relationship between the plurality of grooves 32 in the striker platform 30 and their corresponding strings from the plurality of strings 12.

FIG. 3 also discloses a sectional side view of the pickup 36 used in the preferred electronic embodiment of the present invention, as well as a side view of the beginning portion of the neck 8 with its accompanying plurality of frets 60. In the preferred embodiment the plurality of frets 60 is used to vary the pitch and notes of the plurality of strings 12 and is well known in the art.

Figure 4A:
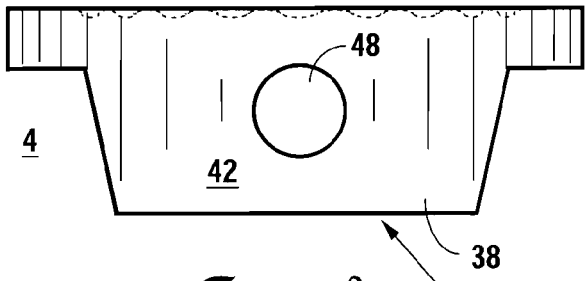
FIGS. 4*a*, 4*b*, 4*c*, and 4*d* are exploded views of a strumming apparatus in the preferred embodiment of the present invention.
Figure 4B:
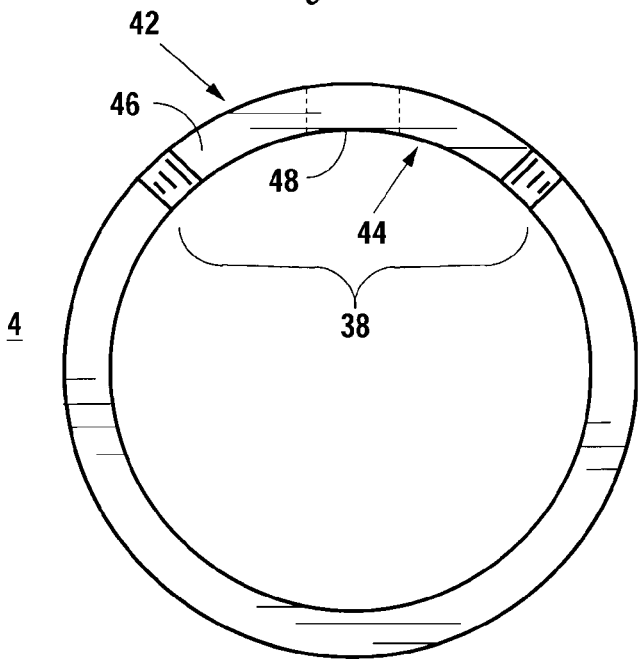
Figure 4C:
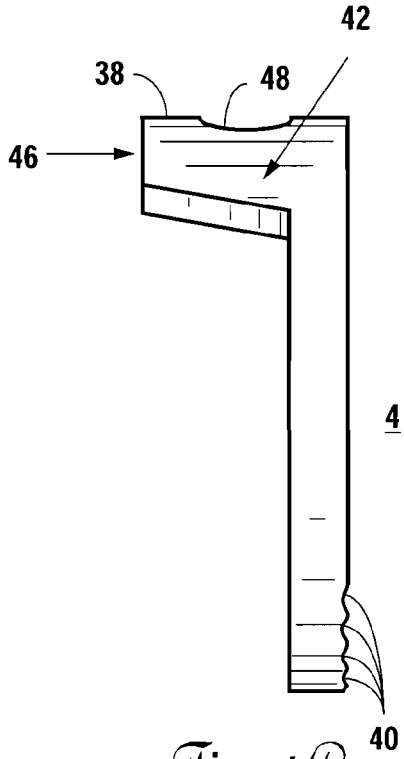
Figure 4D:
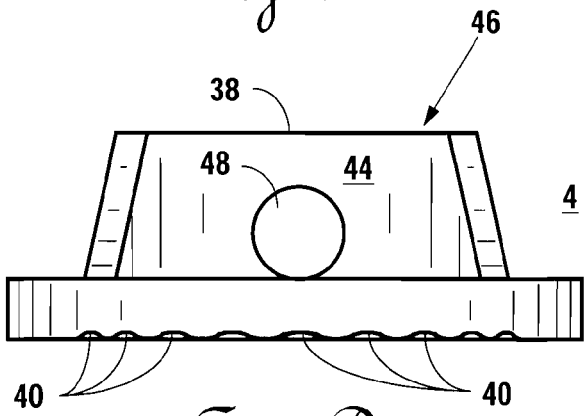

FIGS. 4*a*, 4*b*, 4*c*, and 4*d* are exploded views of the strumming apparatus 4 in its preferred embodiment, wherein: FIG. 4*a* is a front elevation view, FIG. 4*b* is a top plan view, FIG. 4*c* is a side elevation view, and FIG. 4*d* is a rear elevation view. In the preferred embodiment, the strumming apparatus 4 is cylindrical in shape and has a handle 38 for grasping. The handle 38 has a backside 42, a frontside 44, a topside 46, and a stabilizer hole 48. The user of the present invention grasps the strumming apparatus 4 in his/her strumming hand by placing the backside 42 of the handle 38 against the surface of his/her palm and wrapping his/her fingers over the topside 46 of the handle 38, with his/her fingertips resting on the frontside 44 of the handle 38. If desired, the user may place a finger from his/her strumming hand in the stabilizer hole 48 for better control of the strumming apparatus 4. In addition, a stabilizer pad (not shown) may be placed between the palm of the user's hand and the backside 42 of the handle 38 for better control.

Also present in the preferred embodiment of the strumming apparatus 4 are strumming grooves 40. The strumming grooves 40 are accessible for contact with the playing surface 28 of the plurality of strings 12 and act as a series of plectrums or picks. In this regard, the strumming grooves 40 successively pluck each individual string from the plurality of strings 12 when the strumming apparatus 4 contacts and moves across the playing surface 28 (see FIGS. 5*a*, 5*b*, & 6). Without the strumming grooves 40 the strumming apparatus 4 does not produce as much sound from the plurality of strings 12 as it moves over the playing surface 28.

Figure 5A:
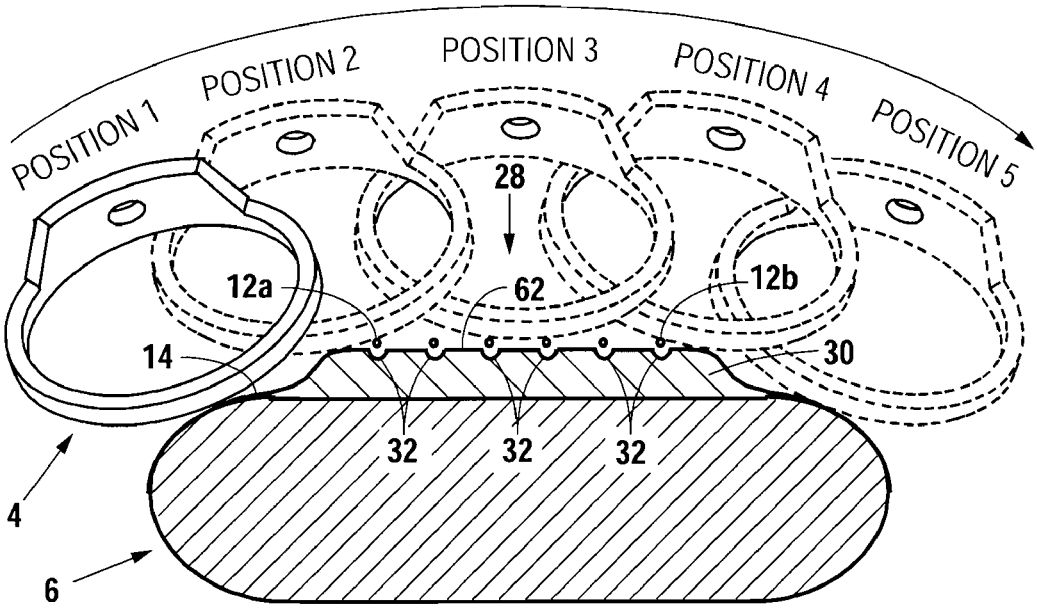
FIGS. 5*a* and 5*b* show cross-sectional views of the preferred embodiment for the stringed instrument at section line 5-5 of FIG. 3, with a side view of the preferred embodiment for the strumming apparatus superimposed over the stringed instrument to illustrate the interaction between the stringed instrument and the strumming apparatus during playing.
Figure 5B:
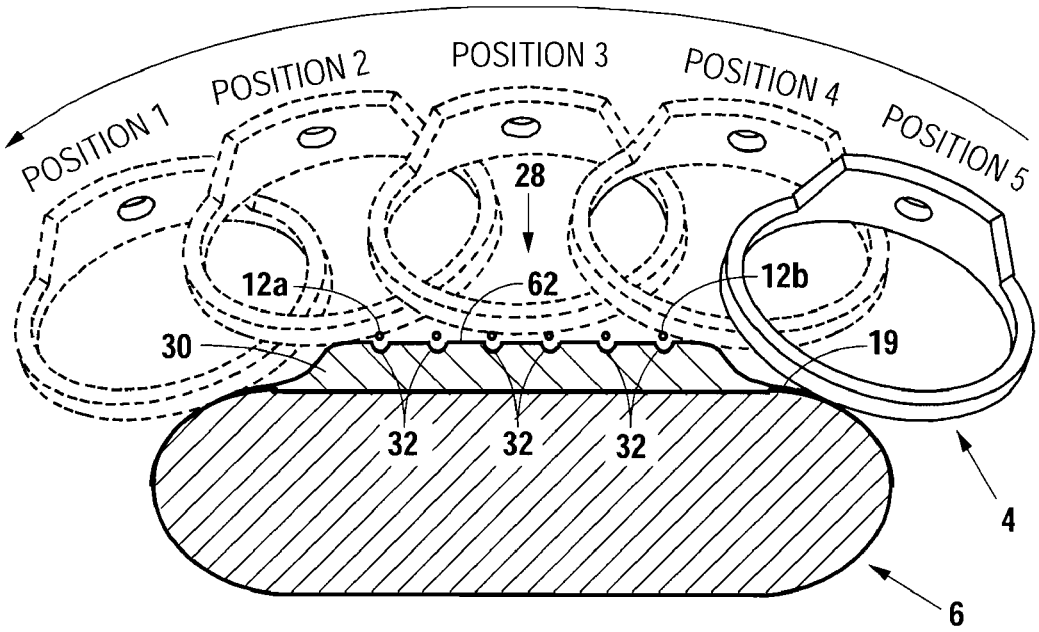
Figure 6:
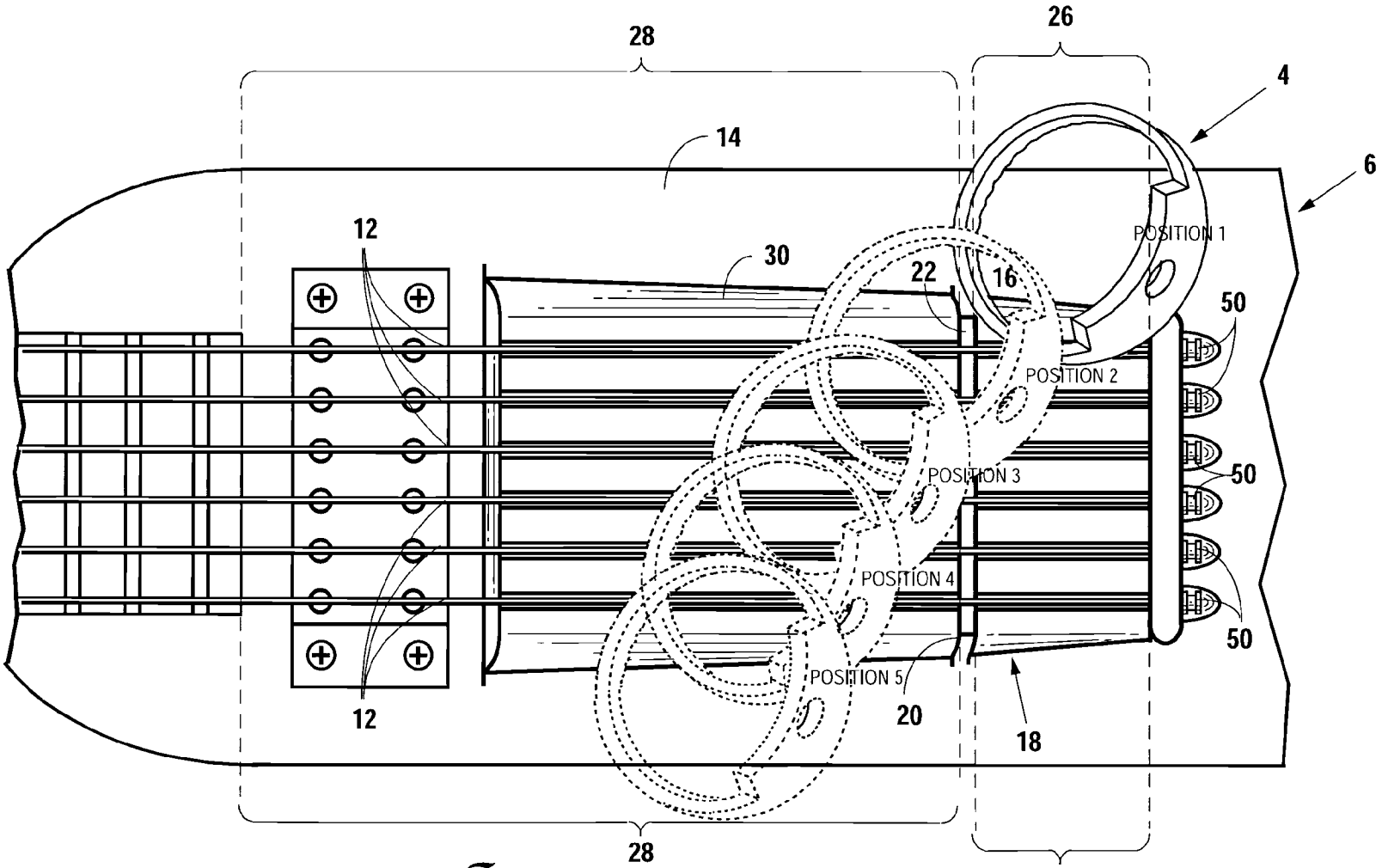
FIG. 6 is an exploded, partial top view of the preferred embodiment of the stringed instrument, with a top view of the preferred embodiment for the strumming apparatus superimposed over the stringed instrument to illustrate the interaction between the stringed instrument and the strumming apparatus during playing.

The strumming apparatus 4 may be any rigid object that the user of the present invention can grasp and that is capable of percussive contact and simultaneous strumming of two or more of the plurality of strings 12, as well as percussive contact with the front surface 14 of the instrument body 6, while the user's strumming hand remains located in its playing position with respect to the instrument body 6 (see FIGS. 5*a*, 5*b*, and 6).

FIGS. 5*a* and 5*b* show a cross-sectional view of the instrument body 6 along section line 5-5 from FIG. 3 and disclose the interaction of the strumming apparatus 4 with the stringed instrument 2 when the present invention is played. With an inward force, the user causes the strumming apparatus 4 to percussively strike individual strings within the plurality of strings 12 while moving the strumming apparatus 4 across the playing surface 28 of the plurality of strings 12 (see FIG. 1). Starting in position 1 on FIG. 5*a*, in an upward playing stroke the strumming apparatus 4 moves through positions 1-5 ending on position 5. Similarly, and as shown in FIG. 5*b*, on a downward playing stroke the strumming apparatus 4 begins in position 5 and moves through the various positions to end back in position 1. The user repeatedly strikes the playing surface 28 of the plurality of strings 12 in a percussive manner while moving the strumming apparatus 4 through positions 1-5 and 5-1 to play the present invention.

The individual positions of the strumming apparatus 4 during upward and downward playing strokes illustrate the functionality of the striker platform 30 in the preferred embodiment of the present invention. At the beginning of an upward stroke, the user exerts an inward force with the strumming apparatus 4 to make the strumming apparatus 4 percussively strike the first string 12*a*. The rapid, percussive manner in which the strumming apparatus 4 is moved toward the first string 12*a* often causes inadvertent, initial contact of the strumming apparatus 4 with the front surface 14 of the instrument body 6 at position 1 of FIG. 5*a*. If this occurs, the user must maintain an inward force toward the front surface 14 while moving the strumming apparatus 4 upward into position 2 to achieve contact with the first string 12*a*. Doing so causes the strumming apparatus 4 to hit the striker platform 30. Once contacted, the striker platform 30 exerts a normal force back against the inward force of the strumming apparatus 30 and causes the strumming apparatus 4 to lift off the front surface 14 of the instrument body 6. Once lifted from the front surface 14, the strumming apparatus 4 can reach its objective and contacts the first string 12*a* at the playing surface 28 of the plurality of strings 12 (see FIG. 1).

Due to the size and shape of the strumming apparatus 4, at some point during upward playing strokes the strumming apparatus 4 may be in simultaneous contact with the striker platform 30 and the first string 12*a*, as shown in position 2 from FIG. 5*a*. Continuing with the upward playing stroke, the strumming apparatus 4 moves from position 2 into position 3, where it is shown in simultaneous contact with two strings on the playing surface 28 of the plurality of strings 12. In practice, simultaneous contact of the strumming apparatus 4 with two or more strings at the playing surface 28 of the plurality of strings 12 can occur throughout movement of the strumming apparatus 4 across the playing surface 28 (i.e., the movement from position 2 through position 4 in FIG. 5*a*, and vice-versa in FIG. 5*b*), depending on the desired sound. In contrast, the user may choose to percussively strike only a single string within the plurality of strings 12 by moving the strumming apparatus 4 in a steeper inward path toward the playing surface 28 of the plurality of strings 12. After position 3, the strumming apparatus 4 moves into position 4 where simultaneous contact of the strumming apparatus 4 with a last string 12*b* and the striker platform 30 may be achieved, and in position 5, the strumming apparatus 4 may again come into simultaneous contact with the striker platform 30 and the instrument body 6 at the end of the upward playing stroke, depending on the manner of playing.

Movement of the strumming apparatus 4 through a downward playing stroke is similar to movement through an upward playing stroke, except that the strumming apparatus 4 starts in position 5 and ends in position 1. The interaction between the strumming apparatus 4 and the front surface 14 of the instrument body 6 and the interaction between the strumming apparatus 4 and the playing surface 28 is simply the reverse of an upward playing stroke. For example, at the beginning of a downward playing stroke the strumming apparatus 4 is in simultaneous contact with the last string 12*b* and the striker platform 30—as shown in position 4 of FIG. 5*b*—when the user is percussively striking the last string 12*b*. Thus, the previous description of the strumming apparatus 4 with the playing surface 28 for the plurality of strings 12 and the front surface 14 of the instrument body 6 applies equally to a downward playing stroke.

Although not shown in FIGS. 5*a* and 5*b*, it should be noted that if the strumming apparatus 4 exerts enough inward force on the plurality of strings 12, individual strings within the plurality of strings 12 are caused to enter into their corresponding groove within the plurality of grooves 32 on the striker platform 30. Once individual strings are within their corresponding groove the strumming apparatus 4 contacts the top surface 62 of the striker platform 30. Depending on the amount and consistency of inward force on the plurality of strings 12, the contact between the striker platform 30 and the strumming apparatus 4 may continue as the strumming apparatus 4 moves from position 2 through position 4 during an upward playing stroke or vice-versa during a downward playing stroke. Regardless of its duration, when this contact occurs the striker platform 30 exerts a normal force back against the inward, percussive force of the strumming apparatus 4. As such, the striker platform 30 in the preferred embodiment limits the amount of inward force the strumming apparatus 4 can exert on the plurality of strings 12.

In alternative embodiments of the present invention the striker platform 30 may not be present. In these alternative embodiments, the strumming apparatus 4 will still move from position 1 through position 5 and vice-versa during upward and downward playing strokes, but the strumming apparatus 4 does not contact the striker platform 30 before contacting the first string 12*a*. Consequently, if the strumming apparatus 4 inadvertently strikes the front surface 14 of the instrument body 6 at position 1 in an upward playing stroke, the strumming apparatus 4 will directly contact the first string 12*a* at position 2 when the user moves the strumming apparatus 4 upward. As such, the tension on the first string 12*a*—as opposed to the striker platform 30—lifts the strumming apparatus 4 from the front surface 14 by exerting a normal force back against the inward force of the strumming apparatus 4 and a great deal of stress is put on the first string 12*a*. Similarly, the last string 12*b* is subjected to increased stress on downward playing strokes without the striker platform 30. In addition to these increased stresses, the plurality of strings 12 incurs greater stresses in this alternative embodiment even when the strumming apparatus 4 does not hit the front surface 14 during a playing stroke. Because the striker platform 30 is not present, the inward force of the strumming apparatus 4 is not limited by the top surface 62 of the striker platform 30 and only the tension in the plurality of strings 12 acts against the percussive strikes of the strumming apparatus 4.

In these alternative embodiments, the inward, percussive force of the strumming apparatus 4 may become too great for individual strings to withstand, thereby causing string breakage. Particularly susceptible are the first string 12*a* and the last string 12*b*, due to a concentration of inward force on these individual strings when the strumming apparatus 4 inadvertently strikes the front surface 14 of the instrument body 6 and is lifted off the same. As a result, the striker platform 30 is present in the preferred embodiment of the present invention.

From a top view, FIG. 6 discloses the movement of the strumming apparatus 4 across the front surface 14 of the instrument body 6 and the playing surface 28 of the plurality of strings 12. In this view, the strumming apparatus 4 is shown inadvertently contacting the front surface 14 of the instrument body 6 and moving across the playing surface 28 of the plurality of strings 12. The path of the strumming apparatus over the bridge/saddle assembly 20 and the first-end area 26 after inadvertent contact with the front surface 14 shows the necessity of the recessive measures in the present invention.

During inadvertent contact in an upward playing stroke, the strumming grooves 40 of the strumming apparatus 4 are shown contacting the front surface 14 of the instrument body 6 at position 1. Here, the upward side of the strumming apparatus 4 passes over (1) the outward protrusion 16 of the instrument body 6; (2) the first string 12*a*, which is recessed into a first-end groove 56 in the first-end area 26 of the plurality of strings 12; and, (3) the string-attaching assembly 18 comprised of the bridge/saddle assembly 20 and the tailpiece 24. In position 2, the strumming grooves 40 of the strumming apparatus 4 simultaneously contact (1) the striker platform 30; (2) the plurality of strings 12 at the playing surface 28; (3) the outward protrusion 16 of the instrument body 6; and, (4) the top surface of the saddle 22 from the bridge/saddle assembly 20.

Whether the strumming apparatus 4 contacts the front surface 14, and if so, the exact location of that contact, as well as where the strumming apparatus 4 contacts the playing surface 28, will vary with every stroke, especially as the speed and repetition of playing strokes increase. During certain strokes the strumming apparatus 4 will follow the path and contact the instrument body 6 as shown in FIG. 6, whereas in certain other playing strokes the strumming apparatus 4 may initially contact the front surface 14 of the instrument body 6 closer to the tailpiece 24 or not at all. In instances where the strumming apparatus 4 does inadvertently contact the front surface 14, the string-attaching assembly 18 must be recessed to prevent obstruction of the strumming apparatus 4 as it transitions from the front surface 14 of the instrument body 6 to the playing surface 28. To accomplish this, the outward protrusion 16 of the instrument body 6 recesses the string-attaching assembly 18 with an outward slope (see FIG. 3), and when the strumming apparatus 4 comes into contact with the outward protrusion 16, the strumming apparatus 4 slides on the slope toward the playing surface 28 without obstruction from the string-attaching assembly 18 or the first-end area 26.

Other possible obstructions should either be eliminated by recessing them below the front surface 14 or be minimized by contouring the edges of the possible obstruction similar to the contoured edges of the outward protrusion 16. As an example of the former, the knob ends 50 of the plurality of strings 12 are recessed below the front surface 14 in the preferred embodiment of the string-attaching assembly 18. As another example of the former, the electronic controls 34 and at least a portion of the pickup 36 (e.g., the mounting brackets) are recessed below the front surface 14 in the preferred electronic embodiment. For an example of the latter, the striker platform 30 is contoured at its edges and allows the strumming apparatus 4 to smoothly transition from the front surface 14 of the instrument body 6 to the playing surface 28 without becoming obstructed (see FIGS. 5*a* & 5*b*). In sum, all substantial obstructions should be eliminated or minimized from the front surface 14 of the instrument body 6 to allow smooth transition of the strumming apparatus 4 from the front surface 14 to the playing surface 28, if and when the strumming apparatus 4 inadvertently contacts the front surface 14.

FIG. 6 also gives insight into the overall functionality and usefulness of the present invention. During playing, the user moves his/her strumming hand in an arced path as shown by the path of the handle 38. Due to the shape of the strumming apparatus 4, movement of the strumming hand at the handle 38 causes the strumming grooves 40 of the strumming apparatus 4 (see FIG. 4) to move about the playing surface 28 of the plurality of strings 12 in an even larger arced path. In this regard, the strumming apparatus 4 acts as a radial extension of the strumming hand and movement of the strumming hand at the handle 38 causes greater movement (i.e., a bigger arc) and therefore increased speed of the strumming grooves 40 at playing surface 28. Thus, instead of a user having to move his/her strumming hand about the entire playing surface 28 to reach and contact every string, the user of the present invention can achieve the same contact with less movement of his/her strumming hand and can do so with greater speed, which increases rhythmic precision.

Furthermore, the size of the strumming apparatus 4 enables simultaneous contact of two or more strings in the plurality of strings 12 if desired. Consequently, the user has a greater ability to strum the plurality of strings 12 rapidly, which also contributes to a more precise rhythm. Combining the increased arced path of the user's strumming hand due to the radial extension from the strumming apparatus 4 and the simultaneous contact of the plurality of strings 12 by the strumming apparatus 4, the present invention is capable of producing a precise rhythmic sound previously unknown in the art.

The present invention is described above in terms of a preferred illustrative embodiment of a specifically described stringed instrument. Those skilled in the art will recognize that alternative constructions of such a stringed instrument can be used in carrying out the present invention.

Other aspects, features, and advantages of the present invention may be obtained from a study of this disclosure and the drawings, along with the appended claims. For example, a different string-attaching assembly 18 other than that shown may be utilized. As a result, the string-attaching assembly 18 may be situated differently on the front surface 14 of the instrument body 6 and the first-end area 26 may be oriented differently within the string-attaching assembly 18. Consequently, in alternative embodiments, the outward protrusion 16 may have a different shape so that the first-end area 26 and the string-attaching assembly 18 are properly recessed. Another alternative embodiment may be shown if the outward protrusion 16 and the instrument body 6 are formed as a single piece and/or the striker platform 30 and the instrument body 6 are formed as a single piece, although separately manufactured pieces are preferred.

I claim:

1. A stringed instrument comprising:

a body having a front surface;

a string-attaching assembly attached to said body;

a plurality of strings aligned to define a playing surface, said plurality of strings attached to said string-attaching assembly; and a striker platform located below said playing surface, said striker platform having at least one groove adapted to receive the unimpeded entry and vibration of said plurality of strings into and at least partially within said at least one groove when said plurality of strings is played.

2. The stringed instrument as in claim 1 wherein said string-attaching assembly comprises a bridge and a tailpiece, wherein said bridge elevates said plurality of strings away from said front surface.

3. The stringed instrument as in claim 2 wherein said string-attaching assembly has a saddle mounted on said bridge.

4. The stringed instrument as in claim 1 wherein said body includes at least one pickup at least partially recessed into said front surface.

5. The stringed instrument in claim 4 wherein said body includes at least one electronic control recessed into said front surface.

6. The stringed instrument of claim 1 further comprising a strumming apparatus shaped to simultaneously and percussively contact at least two of said plurality of strings when moved across said playing surface.

7. The stringed instrument as in claim 6 wherein said strumming apparatus has a rounded shape.

8. The stringed instrument as in claim 7 wherein said strumming apparatus has a cylindrical shape.

9. The strumming apparatus as in claim 8 wherein said strumming apparatus has a handle.

10. The strumming apparatus as in claim 8 wherein said strumming apparatus has a plurality of strumming grooves defined in a string-contacting portion thereof.

11. The stringed instrument of claim 6 wherein said strumming apparatus further comprises:

a substantially cylindrical body portion having a string-contacting portion disposed thereon, said string-contacting portion defined by a plurality of strumming grooves; and a handle extending outwardly from said cylindrical portion.

12. The stringed instrument of claim 1 wherein comprising an outward protrusion extending from said front surface, wherein said string-attaching assembly is substantially recessed into said outward protrusion; and wherein a portion of each of said plurality of strings is recessed into said outward protrusion.

13. A stringed instrument comprising:

a body having a string-attaching assembly substantially recessed into said body;

a plurality of strings defining a playing surface, said plurality of strings attached to said string-attaching assembly, wherein at least a portion of each of said plurality of strings is recessed into said body; and a striker platform located below said playing surface, said striker platform having at least one groove adapted to receive the unimpeded entry and vibration of said plurality of strings into and at least partially within said at least one groove when said plurality of strings is played.

* * * * *